US005934751A

United States Patent [19]

Johnson et al.

[11] Patent Number: 5,934,751

[45] Date of Patent: Aug. 10, 1999

[54] CHAIR ATTACHMENT

[76] Inventors: David H. Johnson; Jo Ann M. Johnson, both of 3070 Queen Frederica Drive #38, Mississauga, Ontario, Canada, L4Y 3A9

[21] Appl. No.: 09/174,346

[22] Filed: Oct. 15, 1998

[51] Int. Cl.[6] ..... A47C 1/08

[52] U.S. Cl. ..... 297/252; 297/378.1; 297/411.29; 297/184.1

[58] Field of Search ..... 297/250.1, 252, 297/378.1, 411.29, 411.26, 184.1, 184.16, 452.1, 195.11, 452.21, 452.23, 452.24, 440.21

[56] References Cited

U.S. PATENT DOCUMENTS

| | | | |
|---|---|---|---|
| 645,878 | 3/1900 | Tennyson | 297/252 |
| 2,605,815 | 8/1952 | Zoranovich | 297/250.1 |
| 2,836,223 | 5/1958 | Kent | 297/252 |
| 2,841,207 | 7/1958 | Sweeney | 297/252 |
| 5,720,522 | 2/1998 | Habeck | 297/195.11 X |

FOREIGN PATENT DOCUMENTS

| | | | |
|---|---|---|---|
| 190205 | 12/1922 | United Kingdom | 297/411.29 |

*Primary Examiner*—Milton Nelson, Jr.

[57] ABSTRACT

A chair attachment for mounting on a bench, in particular a bench seat of a picnic table for providing a comfortable seat for a user. The chair attachment includes a seat and a backrest pivotally coupled thereto. A generally rectangular U-shaped mounting bracket is coupled to the bottom face of the seat for helping hold the seat in a fixed position when rested on a bench of a picnic table.

11 Claims, 4 Drawing Sheets

CHAIR ATTACHMENT

BACKGROUND OF THE INVENTION

1. Field of the Invention

The present invention relates to chair attachments and more particularly pertains to a new chair attachment for mounting on a bench, in particular a bench seat of a picnic table for providing a comfortable seat for a user.

2. Description of the Prior Art

The use of chair attachments is known in the prior art. More specifically, chair attachments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,994,529; U.S. Pat. No. 645,878; U.S. Pat. No. 5,110,184; U.S. Pat. No. 3,066,980; U.S. Pat. No. 4,674,631; PCT Patent No. WO 88/10079 A1 by Williams; and PCT Patent No. WO 96/04824 A1 by Williams et al.

While these devices fulfill their respective, particular objectives and requirements, the aforementioned patents do not disclose a new chair attachment. The inventive device includes a seat and a backrest pivotally coupled thereto. A generally rectangular U-shaped mounting bracket is coupled to the bottom face of the seat for helping hold the seat in a fixed position when rested on a bench of a picnic table.

In these respects, the chair attachment according to the present invention substantially departs from the conventional concepts and designs of the prior art, and in so doing provides an apparatus primarily developed for the purpose of mounting on a bench, in particular a bench seat of a picnic table for providing a comfortable seat for a user.

SUMMARY OF THE INVENTION

In view of the foregoing disadvantages inherent in the known types of chair attachments now present in the prior art, the present invention provides a new chair attachment construction wherein the same can be utilized for mounting on a bench, in particular a bench seat of a picnic table for providing a comfortable seat for a user.

The general purpose of the present invention, which will be described subsequently in greater detail, is to provide a new chair attachment apparatus and method which has many of the advantages of the chair attachments mentioned heretofore and many novel features that result in a new chair attachment which is not anticipated, rendered obvious, suggested, or even implied by any of the prior art chair attachments, either alone or in any combination thereof.

To attain this, the present invention generally comprises a seat and a backrest pivotally coupled thereto. A generally rectangular U-shaped mounting bracket is coupled to the bottom face of the seat for helping hold the seat in a fixed position when rested on a bench of a picnic table.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new chair attachment apparatus and method which has many of the advantages of the chair attachments mentioned heretofore and many novel features that result in a new chair attachment which is not anticipated, rendered obvious, suggested, or even implied by any of the prior art chair attachments, either alone or in any combination thereof.

It is another object of the present invention to provide a new chair attachment which may be easily and efficiently manufactured and marketed.

It is a further object of the present invention to provide a new chair attachment which is of a durable and reliable construction.

An even further object of the present invention is to provide a new chair attachment which is susceptible of a low cost of manufacture with regard to both materials and labor, and which accordingly is then susceptible of low prices of sale to the consuming public, thereby making such chair attachment economically available to the buying public.

Still yet another object of the present invention is to provide a new chair attachment which provides in the apparatuses and methods of the prior art some of the advantages thereof, while simultaneously overcoming some of the disadvantages normally associated therewith.

Still another object of the present invention is to provide a new chair attachment for mounting on a bench, in particular a bench seat of a picnic table for providing a comfortable seat for a user.

Yet another object of the present invention is to provide a new chair attachment which includes a seat and a backrest pivotally coupled thereto. A generally rectangular U-shaped mounting bracket is coupled to the bottom face of the seat for helping hold the seat in a fixed position when rested on a bench of a picnic table.

Still yet another object of the present invention is to provide a new chair attachment that may include armrest and umbrella attachments for providing additional comfort to the user.

Even still another object of the present invention is to provide a new chair attachment that provides a backrest for a user sitting on a picnic table bench seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
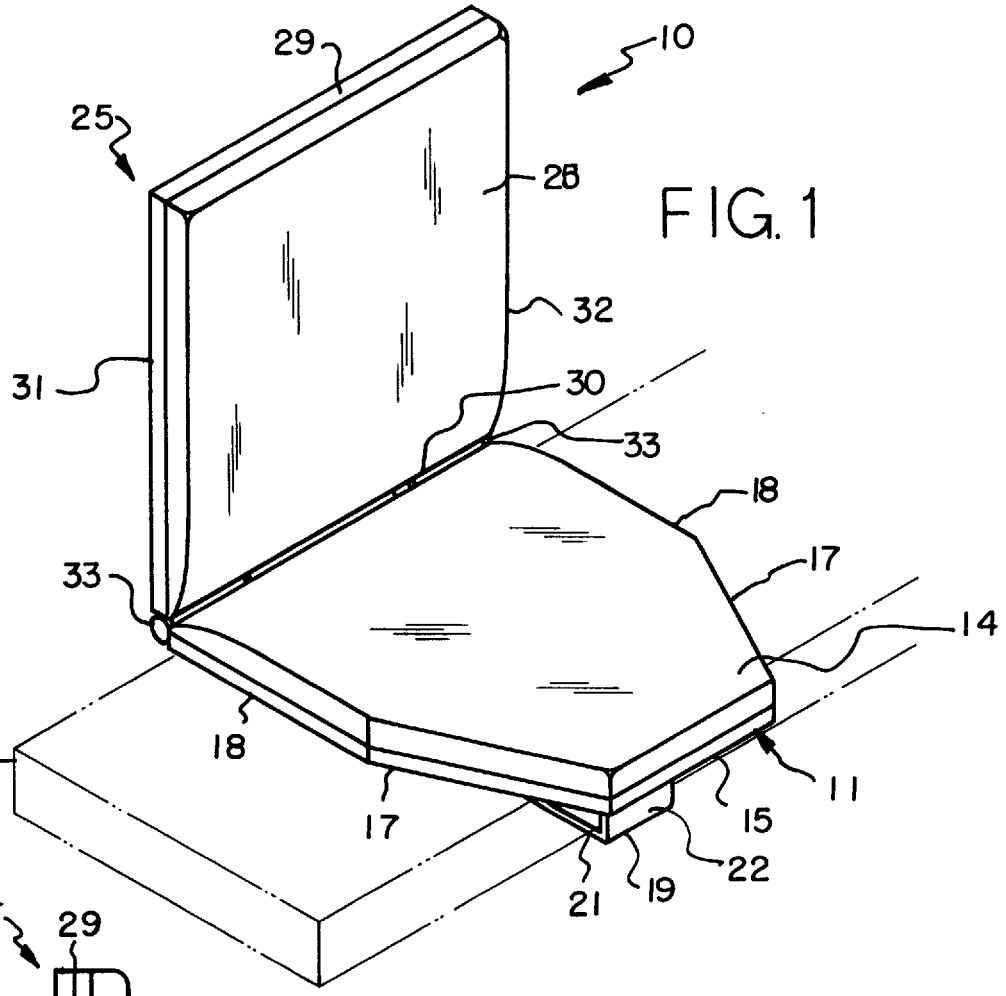
FIG. 1 is a schematic perspective view of a new chair attachment in use on a bench according to the present invention.
Figure 2:
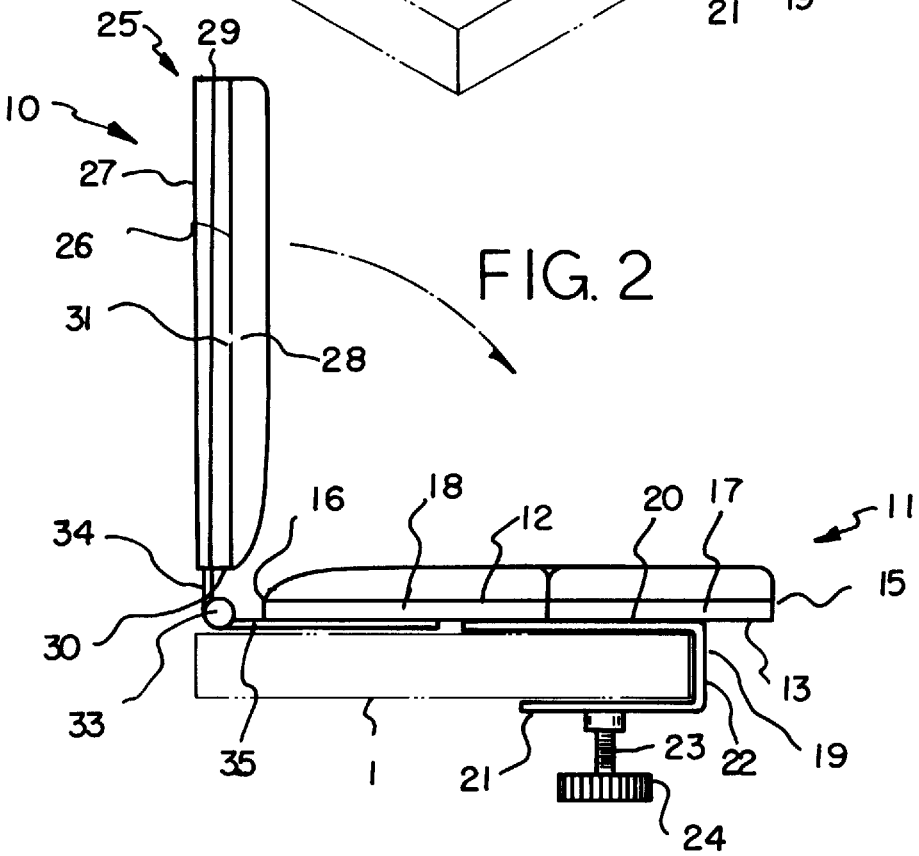
FIG. 2 is a schematic side view of the present invention in use on a bench.
Figure 3:
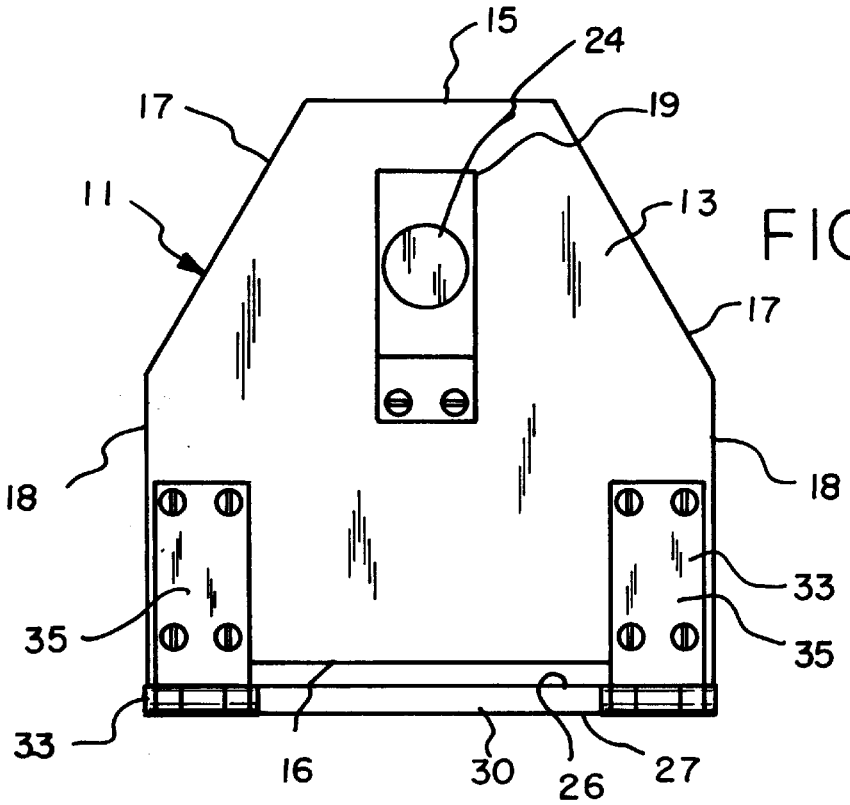
FIG. 3 is a schematic bottom view of the seat of the present invention.
Figure 4:
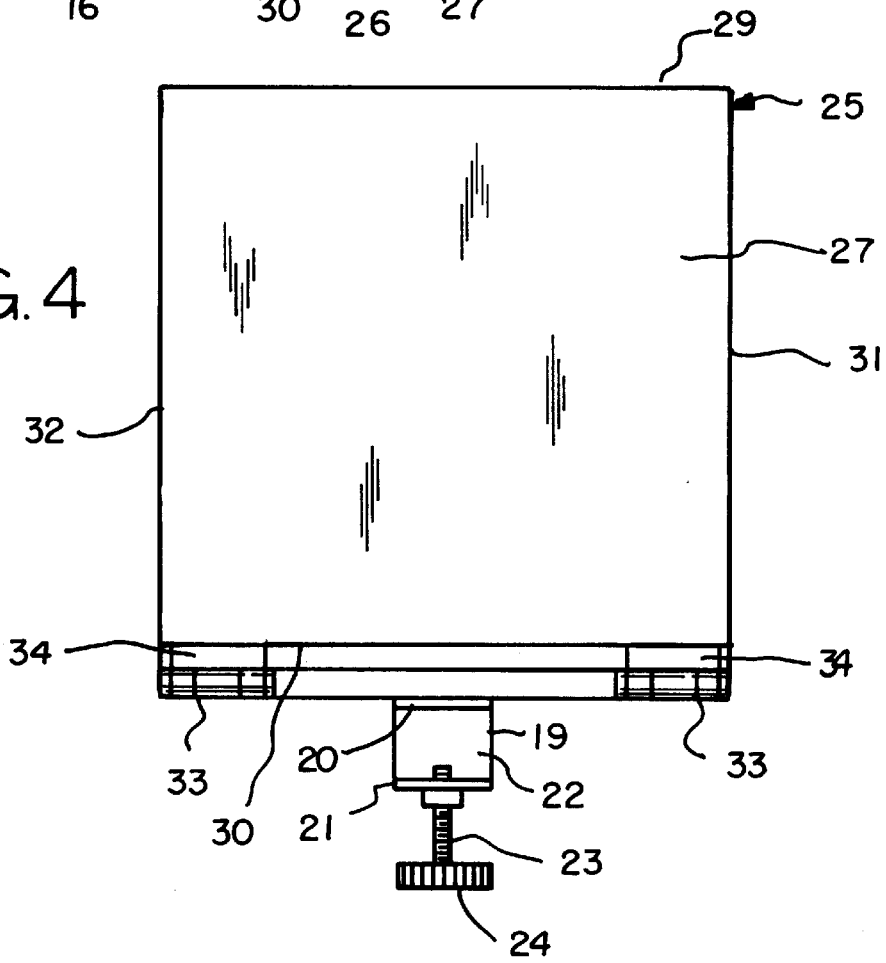
FIG. 4 is a schematic back view of the backrest of the present invention.
Figure 5:
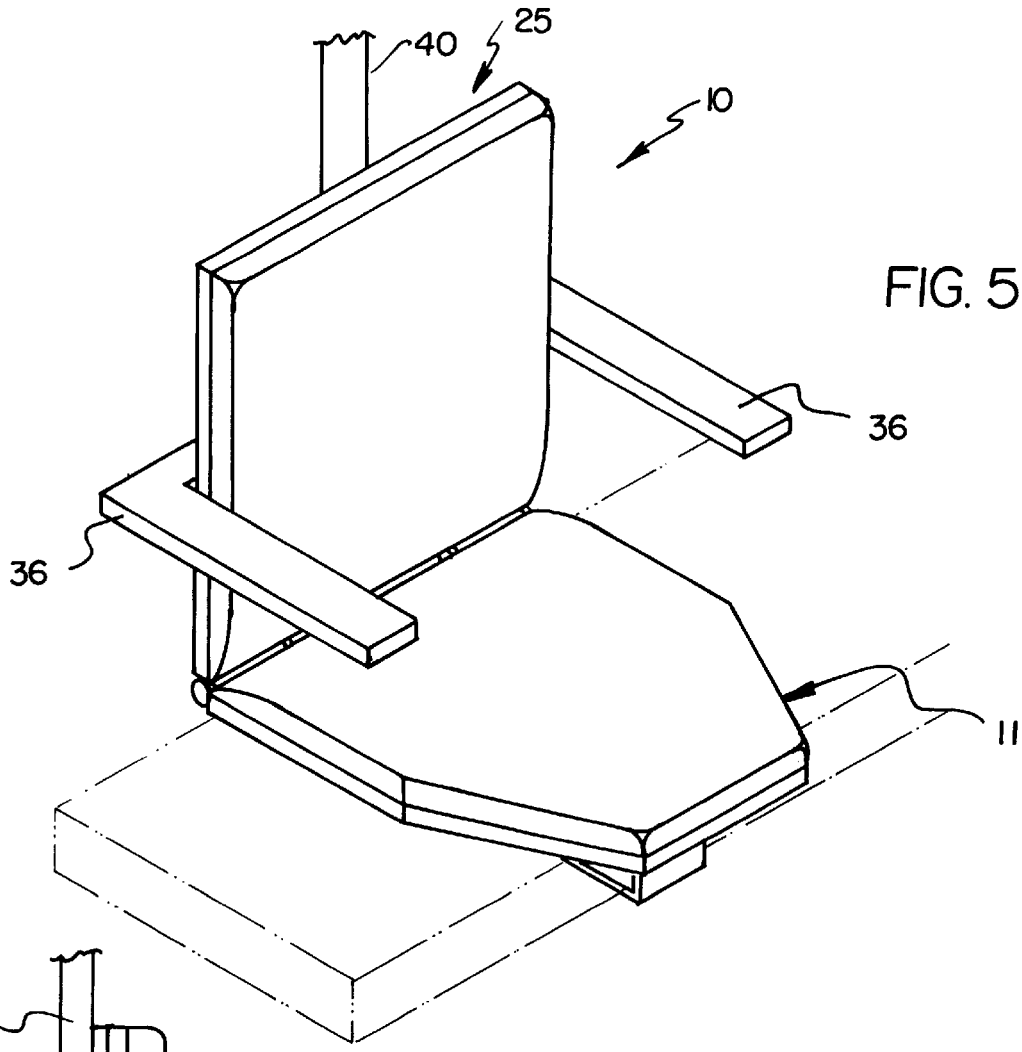
FIG. 5 is a schematic perspective view of an optional embodiment of the present invention.
Figure 6:
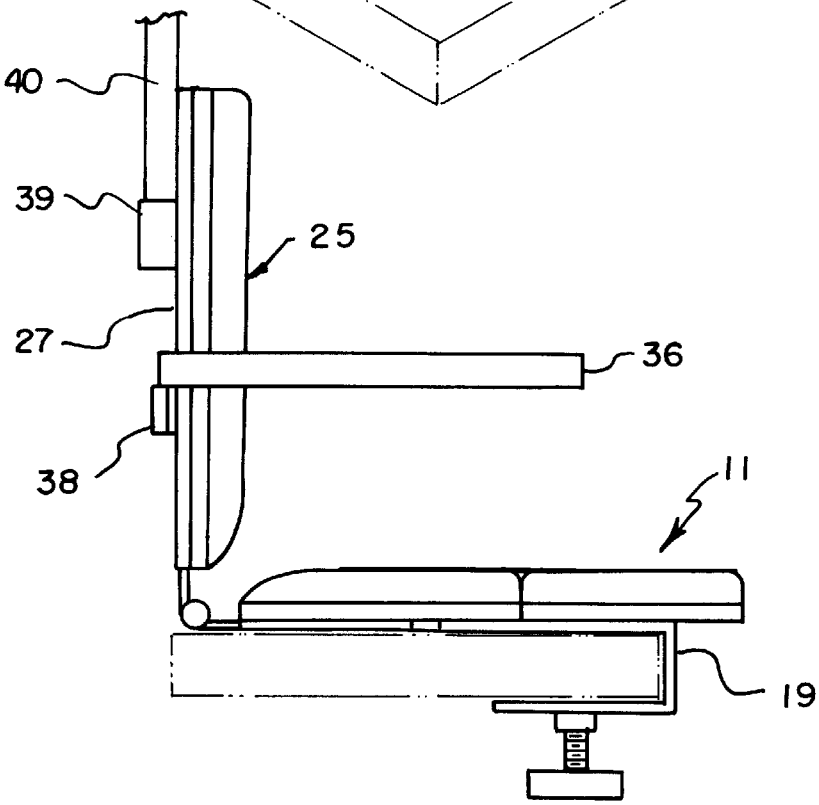
FIG. 6 is a schematic side view of the optional embodiment of the present invention.
Figure 7:
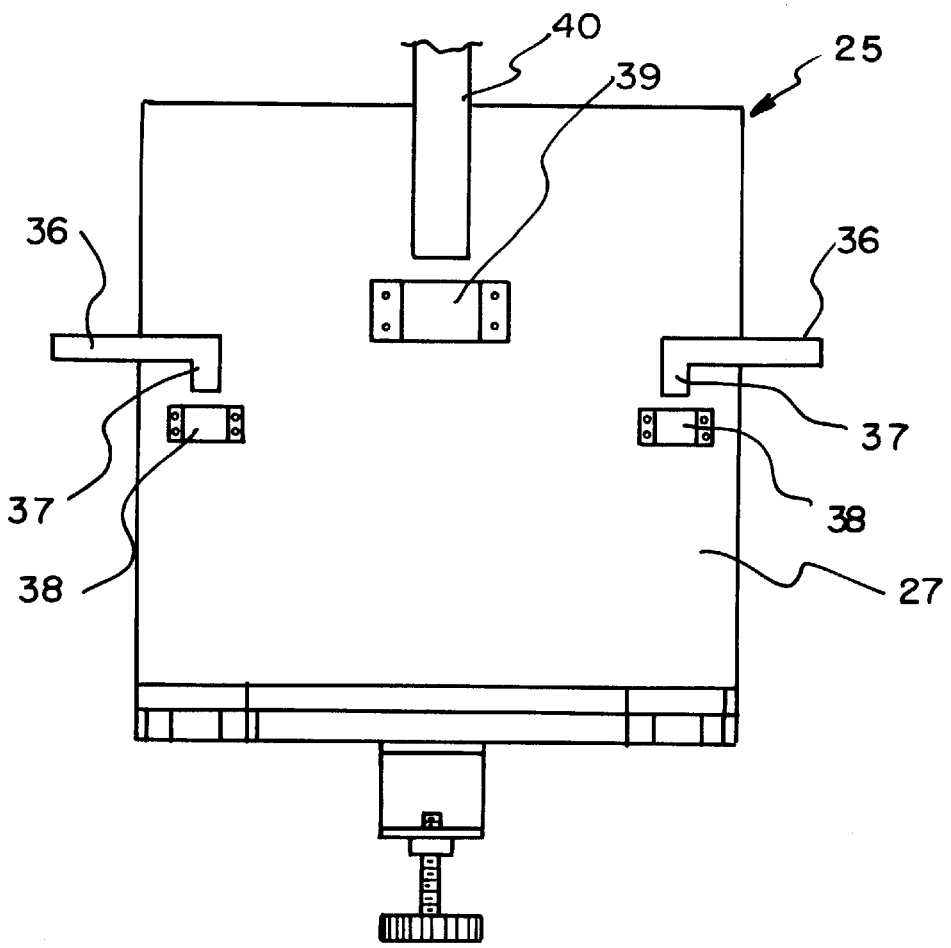
FIG. 7 is a schematic exploded back view of the optional embodiment of the present invention.

With reference now to the drawings, and in particular to FIGS. 1 through 7 thereof, a new chair attachment embodying the principles and concepts of the present invention and generally designated by the reference numeral 10 will be described.

As best illustrated in FIGS. 1 through 7, the chair attachment 10 generally comprises a seat 11 and a backrest 25 pivotally coupled thereto. A generally rectangular U-shaped mounting bracket 19 is coupled to the bottom face 13 of the seat 11 for helping hold the seat 11 in a fixed position when rested on a bench 1 of a picnic table.

In closer detail, chair attachment 10 is designed for mounting to a bench 1 of a picnic table and is also easily transported between locations. The seat 11 has substantially planar top and bottom faces 12,13, a front, and a back. The top and bottom faces 12,13 of the seat 11 preferably generally lie in generally parallel planes to one another. The top face 12 of the seat 11 preferably has a resiliently compressible top padded layer 14 substantially covering the top face 12 of the seat 11.

The seat 11 has a generally six-sided outer perimeter including generally straight front and back edges 15,16, a pair of generally straight forwards side edges 17 and a pair of generally straight rearwards side edges 18. The front edge 15 of the seat 11 is located at the front of the seat 11 and the back edge 16 of the seat 11 is located at the back of the seat 11. The front and back edges 15, 16 of the seat 11 are extended generally parallel to one another. The forwards and rearwards side edges 18 of the seat 11 are interposed between the front and back edges 15,16 of the seat 11. The forwards side edges 17 is positioned adjacent the front edge 15 of the seat 11, the rearwards side edges 18 is positioned adjacent the back edge 16 of the seat 11. The rearwards side edges 18 of the seat 11 are extended generally perpendicular to the back side edge of the seat 11. Each of the forwards side edges 17 of the seat 11 is positioned adjacent an associated rearwards side edge 18. Each forwards side edge 17 of the seat 11 is extended at an obtuse angle with respect to the associated rearwards side edge 18 of the seat 11. Each of the forwards side edges 17 of the seat 11 is extended at an obtuse angle with respect to the front edge 15 of the seat It to define a pair of side bevels designed for comfortable positioning the legs of a user sitting on the seat 11 so that there are no right angled corners on the front portion of the outer perimeter of the seat 11 for the using to scratch their legs on. The front edge 15 and the forwards side edges 17 of the seat 11 define a generally trapezoidal front region defined therebetween while the back edge 16 and the rearwards side edges 18 of the seat 11 defining a generally rectangular back region defined therebetween.

The seat 11 has a length defined between the front and back side edges of the seat 11, a width defined between the rearwards side edges 18 of the seat 11, and a thickness defined between the top and bottom faces 12, 13 of the seat 11. In an ideal illustrative embodiment, the length of the seat 11 is about 15 inches the width of the seat 11 is about 15 inches, and the thickness of the seat 11 is about ½ inches. Each of the edges of the seat 11 has a length. In the idea illustrative embodiment, the length of the front edge 15 of the seat 11 is about 4 inches, the length of the back edge 16 of the seat 11 is about 15 inches, the length of each of the forwards side edges 17 of the seat 11 is about 8 inches, and, the length of each of the rearwards side edges 18 of the seat 11 is about 6 inches.

The generally rectangular U-shaped mounting bracket 19 has spaced apart upper and lower arms 20,21 and a cross portion 22 connecting the upper and lower arms 20,21 of the mounting bracket 19 together. The upper arm 20 of the mounting bracket 19 is coupled to the bottom face 13 of the seat 11 in the front region of the seat 11. The cross portion 22 of the mounting bracket 19 is positioned towards the front edge 15 of the seat 11, the upper and lower arms 20,21 of the mounting bracket 19 each has a length extending from the cross portion 22 of the mounting bracket 19 extending generally parallel to the rearwards side edges 18 of the seat 11.

In use, the bottom face 13 of the seat 11 is designed for resting on a bench 1 of a picnic table with the upper and lower arms 20,21 of the mounting bracket 19 defining a space therebetween designed for positioning the bench 1 of the picnic table therein to help hold the seat 11 in a position on the bench 1. The lower arm 21 of the mounting bracket 19 has a threaded bore therethrough. The lower arm 21 of the mounting bracket 19 has a threaded fastener 23 extending through the threaded bore of the lower arm 21 into the space between the upper and lower arms 20,21 of the mounting bracket 19. In use, the threaded fastener 23 is designed for clamping the bench 1 in the space between the upper and lower arms 20,21 between the upper arm 20 and the end of the threaded fastener 23. The threaded fastener 23 preferably has a turning knob 24 downwardly depending from the lower arm 21 designed for aiding the turning of the threaded fastener 23 in the threaded bore.

The backrest 25 has substantially planar front and back faces 26, 27, a top and a bottom. The front and back faces 26, 27 of the backrest 25 preferably generally lie in generally parallel planes to one another. The front face 26 of the backrest 25 also preferably has a resiliently compressible front padded layer 28 substantially covering the front face 26 of the backrest 25. The backrest 25 has a generally rectangular outer perimeter including generally straight top and bottom edges 29,30, and a pair of generally straight side edges 31, 32 extending between the top and bottom edges 29,30 of the backrest 25. The top edge 29 of the backrest 25 is located at the top of the backrest 25 and the bottom edge 30 of the backrest 25 is located at the bottom of the backrest 25. The top and bottom edges 29,30 of the backrest 25 are extended generally parallel to one another. The side edges 31,32 of the backrest 25 are extended generally parallel to one another and generally perpendicular to the top and bottom edges 29,30 of the backrest 25. The backrest 25 has a height defined between the top and bottom edges 29,30 of the backrest 25, a width defined between the side edges of the backrest 25, and a thickness defined between the front and back faces 26,27 of the backrest 25. In the ideal illustrative embodiment, the height of the backrest 25 is about 20 inches, the width of the backrest 25 is about 15 inches, and the thickness of the backrest 25 is about ½ inches.

The bottom of the backrest 25 is pivotally coupled to the back of the seat 11. Preferably, a pair of hinges 33 pivotally couple the bottom of the backrest 25 to the back of the seat 11. Each of the hinges 33 has a top leaf 34 fixedly inserted into the bottom edge 30 of the back rest and a bottom leaf 35 coupled to the bottom face 13 of the seat 11. In use, the backrest 25 is pivotable between a generally vertical position generally perpendicular to the seat 11 and a generally horizontal position generally parallel to the seat 11 with the front face 26 and the top face 12 facing each other so that the attachment 10 may be easily transported and conveniently stored when not in use.

Optionally, the attachment 10 may include a pair of armrests 36 forwardly extending from the backrest 25 above the seat 11. One of the armrests is positioned adjacent of the side edges 31 of the backrest 25 and the other armrest is positioned adjacent another of the side edges 32 of the backrest 25. Each of the armrests 36 has a rear prong 37 downwardly depending therefrom. The back face 27 of the backrest 25 has a pair of generally U-shaped armrest mounting brackets 38 coupled thereto. One of the armrest mounting brackets is positioned adjacent one of the side edges 31 of the backrest 25 and another of the armrest mounting brackets is positioned adjacent another of the side edges 32 of the backrest 25. Each of the armrest mounting brackets 38 defines a mounting hole. The rear prong of one of the armrests is inserted into the mounting hole of one of the armrest mounting brackets to mount the armrest to the back face of the backrest and the rear prong of another of the armrests is inserted into the mounting hole of another of the armrest mounting brackets to mount the armrest to the back face of the backrest. The back face 27 of the backrest 25 may further optionally include a generally U-shaped top mounting bracket 39 coupled thereto, the top mounting bracket 39 defining a space designed for receiving a pole 40 of an umbrella therein such that the umbrella is spread above the seat 11 to provide shade and overhead protection to the seat 11 from rain and other precipitation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An attachment for mounting to a bench structure, said attachment comprising:

a seat having top and bottom faces, a front, and a back;

a generally rectangular U-shaped mounting bracket having spaced apart upper and lower arms and a cross portion connecting said upper and lower arms of said mounting bracket together;

said upper arm of said mounting bracket being coupled to said bottom face of said seat;

said bottom face of said seat being adapted for resting on a bench, said upper and lower arms of said mounting bracket defining a space therebetween adapted for positioning the bench therein;

a backrest having front and back faces, a top and a bottom;

said backrest having a bottom edge, said bottom edge of said backrest being located at said bottom of said backrest;

and a pair of hinges pivotally coupling said bottom of said backrest to said back of said seat, each of said hinges having a top leaf inserted into said bottom edge of said back rest and a bottom leaf coupled to said bottom face of said seat.

2. The attachment of claim 1, wherein said seat has a generally six-sided outer perimeter including generally straight front and back edges, a pair of generally straight forwards side edges and a pair of generally straight rearwards side edges, said front edge of said seat being located at said front of said seat, said back edge of said seat being located at said back of said seat, said forwards and rearwards side edges of said seat being interposed between said front and back edges of said seat, said forwards side edges being positioned adjacent said front edge of said seat, said rearwards side edges being positioned adjacent said back edge of said seat.

3. The attachment of claim 2, wherein, said front and back edges of said seat are extended generally parallel to one another, wherein said rearwards side edges of said seat are extended generally perpendicular to said back side edge of said seat.

4. The attachment of claim 2, wherein each of said forwards side edges of said seat is positioned adjacent an associated rearwards side edge, each forwards side edge of said seat being extended at an obtuse angle with respect to the associated rearwards side edge of said seat.

5. The attachment of claim 2, wherein each of said fowards side edges of said seat are extended at an obtuse angle with respect to said front edge of said seat.

6. The attachment of claim 1, wherein said lower arm of said mounting bracket has a threaded bore therethrough, said lower arm of said mounting bracket having a threaded fastener extending through said threaded bore of said lower arm into said space between said upper and lower arms of said mounting bracket, said threaded fastener being adapted for clamping the bench in said space between said upper and lower arms between said upper arm and said threaded fastener.

7. The attachment of claim 6, wherein said threaded fastener has a turning knob downwardly depending from said lower arm.

8. The attachment of claim 1, further comprising a pair of armrests forwardly extending from said backrest above said seat, one of said armrests being positioned adjacent a side edge of said backrest, another of said armrests being positioned adjacent another side edge of said backrest.

9. The attachment of claim 8, wherein each of said armrests has a rear prong downwardly depending therefrom, wherein said back face of said backrest has a pair of generally U-shaped armrest mounting brackets coupled thereto, one of said armrest mounting brackets being positioned adjacent one of said side edges of said backrest, another of said armrest mounting brackets being positioned adjacent another of said side edges of said backrest, each of said armrest mounting brackets defining a mounting hole, said rear prong of one of said armrests being inserted into said mounting hole of one of said armrest mounting brackets to mount the armrest to said back face of said backrest, said rear prong of another of said armrests being inserted into said mounting hole of another of said armrest mounting brackets to mount the armrest to said back face of said backrest.

10. An attachment for mounting to a bench structure, said attachment comprising:

a seat having substantially planar top and bottom faces, a front, and a back;

said top and bottom faces of said seat generally lying in generally parallel planes to one another;

said top face of said seat having a resiliently compressible top padded layer substantially covering said top face of said seat;

said seat having a generally six-sided outer perimeter including generally straight front and back edges, a pair of generally straight forwards side edges and a pair of generally straight rearwards side edges;

said front edge of said seat being located at said front of said seat, said back edge of said seat being located at said back of said seat;

said front and back edges of said seat being extended generally parallel to one another;

said forwards and rearwards side edges of said seat being interposed between said front and back edges of said seat, said forwards side edges being positioned adjacent said front edge of said seat, said rearwards side edges being positioned adjacent said back edge of said seat;

said rearwards side edges of said seat being extended generally perpendicular to said back side edge of said seat each of said forwards side edges of said seat being positioned adjacent an associated rearwards side edge, each forwards side edge of said seat being extended at an obtuse angle with respect to the associated rearwards side edge of said seat;

each of said forwards side edge of said seat being extended at an obtuse angle with respect to said front edge of said seat;

said front edge and said forwards side edges of said seat defining a generally trapezoidal front region defined therebetween, said back edge and said rearwards side edges of said seat defining a generally rectangular back region defined therebetween;

a generally rectangular U-shaped mounting bracket having spaced apart upper and lower arms and a cross portion connecting said upper and lower arms of said mounting bracket together;

said upper arm of said mounting bracket being coupled to said bottom face of said seat in said front region of said seat, said cross portion of said mounting bracket being positioned towards said front edge of said seat, said upper and lower arms of said mounting bracket each having a length extending from said cross portion of said mounting bracket extending generally parallel to said rearwards side edges of said seat;

said bottom face of said seat being adapted for resting on a bench, said upper and lower arms of said mounting bracket defining a space therebetween adapted for positioning the bench therein;

said lower arm of said mounting bracket having a threaded bore therethrough, said lower arm of said mounting bracket having a threaded fastener extending through said threaded bore of said lower arm into said space between said upper and lower arms of said mounting bracket, said threaded fastener being adapted for clamping the bench in said space between said upper and lower arms between said upper arm and said threaded fastener, said threaded fastener having a turning knob downwardly depending from said lower arm;

a backrest having substantially planar front and back faces, a top and a bottom;

said front and back faces of said backrest generally lying in generally parallel planes to one another;

said front face of said backrest having a resiliently compressible front padded layer substantially covering said front face of said backrest;

said backrest having a generally rectangular outer perimeter including generally straight top and bottom edges, and a pair of generally straight side edges extending between said top and bottom edges of said backrest;

said top edge of said backrest being located at said top of said backrest, said bottom edge of said backrest being located at said bottom of said backrest;

said top and bottom edges of said backrest being extended generally parallel to one another;

said side edges of said backrest being extended generally parallel to one another and generally perpendicular to said top and bottom edges of said backrest;

said backrest having a height defined between said top and bottom edges of said backrest, a width defined between said side edges of said backrest, and a thickness defined between said front and back faces of said backrest;

said bottom of said backrest being pivotally coupled to said back of said seat, wherein a pair of hinges pivotally couple said bottom of said backrest to said back of said seat, each of said hinges having a top leaf inserted into said bottom edge of said back rest and a bottom leaf coupled to said bottom face of said seat;

a pair of armrests forwardly extending from said backrest above said seat, one of said armrests being positioned adjacent of said side edges of said backrest, another of said armrests being positioned adjacent another of said side edges of said backrest;

each of said armrests having a rear prong downwardly depending therefrom;

said back face of said backrest having a pair of generally U-shaped armrest mounting brackets coupled thereto, one of said armrest mounting brackets being positioned adjacent one of said side edges of said backrest, another of said armrest mounting brackets being positioned adjacent another of said side edges of said backrest;

each of said armrest mounting brackets defining a mounting hole; and said rear prong of one of said armrests being inserted into said mounting hole of one of said armrest mounting brackets to mount the armrest to said back face of said backrest, said rear prong of another of said armrests being inserted into said mounting hole of another of said armrest mounting brackets to mount the armrest to said back face of said backrest.

11. An attachment for mounting to a bench structure, said attachment comprising:

a seat having top and bottom faces, a front, and a back;

a generally rectangular U-shaped mounting bracket having spaced apart upper and lower arms and a cross portion connecting said upper and lower arms of said mounting bracket together;

said upper arm of said mounting bracket being coupled to said bottom face of said seat;

said bottom face of said seat being adapted for resting on a bench, said upper and lower arms of said mounting bracket defining a space therebetween adapted for positioning the bench therein;

a backrest having front and back faces, a top and a bottom;

said bottom of said backrest being pivotally coupled to said back of said seat;

a pair of armrests forwardly extending from said backrest above said seat, one of said armrests being positioned adjacent a side edge of said backrest, another of said armrests being positioned adjacent another side edge of said backrest.

each of said armrests having a rear prong downwardly depending therefrom;

said back face of said backrest having a pair of generally U-shaped armrest mounting brackets coupled thereto;

one of said armrest mounting brackets being positioned adjacent a first side edge of said backrest;

another of said armrest mounting brackets being positioned adjacent a second side edge of said backrest;

each of said armrest mounting brackets defining a mounting hole;

said rear prong of one of said armrests being inserted into said mounting hole of one of said armrest mounting brackets to mount the armrest to said back face of said backrest; and said rear prong of another of said armrests being inserted into said mounting hole of another of said armrest mounting brackets to mount the armrest to said back face of said backrest.

* * * * *